US010686241B2

(12) United States Patent
Bae et al.

(10) Patent No.: US 10,686,241 B2
(45) Date of Patent: Jun. 16, 2020

(54) BOARD-TO-BOARD INTERCONNECT APPARATUS INCLUDING A MICROSTRIP CIRCUIT CONNECTED BY A WAVEGUIDE, WHERE A BANDWIDTH OF A FREQUENCY BAND IS ADJUSTABLE

(71) Applicant: Korea Advanced Institute of Science and Technology, Daejeon (KR)

(72) Inventors: Hyeon Min Bae, Daejeon (KR); Ha Il Song, Daejeon (KR); Huxian Jin, Daejeon (KR)

(73) Assignee: KOREA ADVANCED INSTITUTE OF SCIENCE AND TECHNOLOGY, Daejeon (KR)

( * ) Notice: Subject to any disclaimer, the term of this patent is extended or adjusted under 35 U.S.C. 154(b) by 0 days.

(21) Appl. No.: 15/555,396

(22) PCT Filed: Jun. 2, 2015

(86) PCT No.: PCT/KR2015/005505
§ 371 (c)(1),
(2) Date: Sep. 1, 2017

(87) PCT Pub. No.: WO2016/140401
PCT Pub. Date: Sep. 9, 2016

(65) Prior Publication Data

US 2018/0040937 A1 Feb. 8, 2018

(30) Foreign Application Priority Data

Mar. 3, 2015 (KR) ..... 10-2015-0029742

(51) Int. Cl.
*H01P 5/107* (2006.01)
*H01P 1/203* (2006.01)
(Continued)

(52) U.S. Cl.
CPC ..... *H01P 5/107* (2013.01); *H01P 1/20309* (2013.01); *H01P 3/082* (2013.01);
(Continued)

(58) Field of Classification Search
CPC ..... H01P 5/107; H01P 3/122
(Continued)

(56) References Cited

U.S. PATENT DOCUMENTS

2007/0085626 A1 4/2007 Lee et al.
2008/0266196 A1 10/2008 Shi
(Continued)

FOREIGN PATENT DOCUMENTS

JP 2004530325 A 9/2004
JP 2006500835 A 1/2006
(Continued)

OTHER PUBLICATIONS

International Searching Authority, International Search Report issued in PCT/KR2015/005505 dated Jan. 29, 2016, 2 pages.

*Primary Examiner* — Benny T Lee
(74) *Attorney, Agent, or Firm* — Dinsmore & Shohl LLP; Yongsok Choi, Esq.

(57) ABSTRACT

Disclosed is a chip-to-chip interface using a microstrip circuit and a dielectric waveguide. A board-to-board interconnection device, according to one embodiment of the present invention, comprises: a waveguide which has a metal cladding and transmits a signal from a transmitter-side board to a receiver-side board; and a microstrip circuit which is connected to the waveguide and has a microstrip-to-waveguide transition (MWT), wherein the microstrip circuit matches a microstrip line and the waveguide, adjusts the bandwidth of a predetermined first frequency band among the frequency bands of the signal, and provides same to the receiver.

11 Claims, 8 Drawing Sheets

(51) Int. Cl.

| | |
|---|---|
| ***H01P 3/08*** | (2006.01) |
| ***H01P 3/16*** | (2006.01) |
| ***H01P 5/08*** | (2006.01) |
| ***H01P 5/10*** | (2006.01) |

(52) U.S. Cl.
CPC ..... *H01P 3/16* (2013.01); *H01P 5/087* (2013.01); *H01P 5/1007* (2013.01)

(58) Field of Classification Search
USPC ..... 333/26, 239
See application file for complete search history.

(56) References Cited

U.S. PATENT DOCUMENTS

| | | | | |
|---|---|---|---|---|
| 2010/0148891 | A1 | 6/2010 | Sano | |
| 2010/0225410 | A1 | 9/2010 | Margomenos et al. | |
| 2013/0127563 | A1 | 5/2013 | Gritters et al. | |
| 2014/0184351 | A1* | 7/2014 | Bae et al. ..... | H01P 3/122 333/34 |

FOREIGN PATENT DOCUMENTS

| | | | |
|---|---|---|---|
| JP | 2006191077 | A | 7/2006 |
| JP | 2010141644 | A1 | 6/2010 |
| KR | 101375938 | B1 | 3/2014 |
| WO | 2013152191 | A1 | 10/2013 |
| WO | 2014104536 | A1 | 7/2014 |

* cited by examiner

BOARD-TO-BOARD INTERCONNECT APPARATUS INCLUDING A MICROSTRIP CIRCUIT CONNECTED BY A WAVEGUIDE, WHERE A BANDWIDTH OF A FREQUENCY BAND IS ADJUSTABLE

CROSS REFERENCE TO RELATED APPLICATIONS

This application is a national stage of PCT/KR2015/005505 filed on Jun. 2, 2015, which claims priority to Korean Patent Application No. 10-2015-0029742 filed on Mar. 3, 2015, the entire contents of which are incorporated by reference.

FIELD OF THE INVENTION

Embodiments of the present invention relate to a chip-to-chip interface using a microstrip circuit and a dielectric waveguide.

BACKGROUND

Demand for bandwidth is increasing in wired communications, which requires high speed, low power, and low cost I/O. In conventional copper interconnects, attenuation due to skin effect or the like limits system performance. In order to compensate for losses in the conventional copper interconnects, penalties are applied in terms of power, cost and the like, and the penalties are exponentially increased as a data rate, transmission distance, or the like is increased.

SUMMARY OF THE INVENTION

Since a microstrip circuit according to the embodiments of the invention may provide a transmission signal close to a single sideband signal to a receiver through interaction with a waveguide, it may utilize a twice wider available bandwidth compared to a dual sideband demodulation scheme, and may perform effective data transmission with a wider bandwidth compared to a RF wireless technique due to cutoff channel characteristics exhibiting high roll-off.

Further, the waveguide enables high-speed data communication, and the microstrip circuit including a microstrip-to-waveguide transition (MWT) may transmit a wideband signal while minimizing reflection at a discontinuity. The waveguide may reduce radiation losses and channel losses by enclosing a dielectric with a metal cladding.

Furthermore, although the microstrip circuit according to one embodiment of the invention is described as being used for a board-to-board interface employing a waveguide, the present invention is not limited thereto and may be applied to various fields where a transmission signal may be transmitted with a microstrip line.

For example, the present invention may be applied to an RF transmission or reception antenna system, or to a transmitter and a receiver wired to each other.

A board-to-board interconnect apparatus according to one embodiment of the invention comprises: a waveguide which transmits a signal from a board on the side of a transmitter to a board on the side of a receiver and has a metal cladding; and a microstrip circuit which is connected to the waveguide and has a microstrip-to-waveguide transition (MWT), wherein the microstrip circuit matches a microstrip line and the waveguide, and adjusts a bandwidth of a first predetermined frequency band among frequency bands of the signal to provide the signal to the receiver.

The microstrip circuit may comprise: a microstrip feeding line which supplies the signal in a first layer; a probe element which adjusts the bandwidth of the first frequency band; a slotted ground plane including a slot for minimizing a ratio of reverse-traveling waves to forward-traveling waves in a second layer; a ground plane including vias for forming an electrical connection between the slotted ground plane and the ground plane in a third layer; and a patch for radiating the signal at a resonance frequency.

The probe element may have a characteristic impedance greater than a characteristic impedance of the microstrip feeding line.

The probe element may be connected to an end of the microstrip feeding line, and may have a predetermined width and length.

The length of the probe element may be determined based on a wavelength of the resonance frequency, and the width of the probe element may be 40 to 80% of the width of the microstrip feeding line.

The probe element may adjust the bandwidth of the first frequency band by adjusting a slope of an upper cutoff frequency band.

A microstrip circuit according to one embodiment of the invention comprises: a microstrip feeding line which supplies a signal in a first layer; a probe element which adjusts a bandwidth of a first predetermined frequency band among frequency bands of the signal; a slotted ground plane including a slot for minimizing a ratio of reverse-traveling waves to forward-traveling waves in a second layer; a ground plane including vias for forming an electrical connection between the slotted ground plane and the ground plane in a third layer; and a patch which radiates the signal at a resonance frequency.

The probe element may have a characteristic impedance greater than a characteristic impedance of the microstrip feeding line.

The probe element may be connected to an end of the microstrip feeding line, and may have a predetermined width and length. The length of the probe element may be determined based on a wavelength of the resonance frequency.

The width of the probe element may be 40 to 80% of the width of the microstrip feeding line.

The probe element may adjust the bandwidth of the first frequency band by adjusting a slope of an upper cutoff frequency band.

Since a microstrip circuit according to the embodiments of the invention may provide a transmission signal close to a single sideband signal to a receiver through interaction with a waveguide, it may utilize a twice wider available bandwidth compared to a dual sideband demodulation scheme, and may perform effective data transmission with a wider bandwidth compared to a RF wireless technique due to cutoff channel characteristics exhibiting high roll-off.

DETAILED DESCRIPTION OF THE PREFERRED EMBODIMENTS

Figure 1:
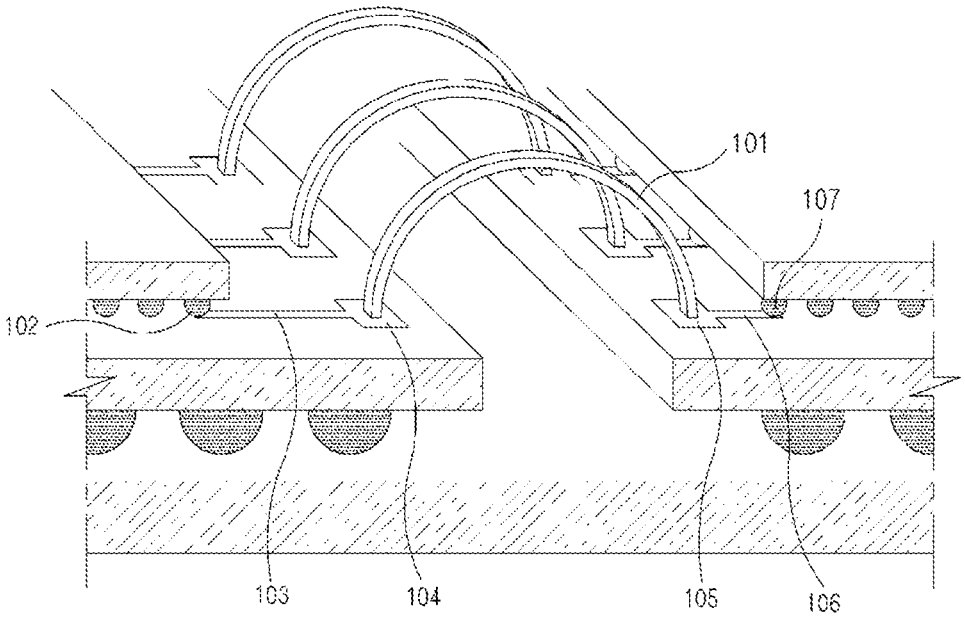
FIG. 1 shows the structure of a chip-to-chip interface for illustrating the invention.

Hereinafter, embodiments of the present invention will be described with reference to the accompanying drawings. Although the limited embodiments are described in the following, these embodiments are examples of the invention and those skilled in the art may easily change the embodiments.

The embodiments of the invention may implement single sideband demodulation by adjusting a bandwidth of an upper cutoff frequency band of a transmission signal. For example, a slope of the upper cutoff frequency band may be adjusted through a microstrip circuit that well matches a microstrip line with a waveguide. When a carrier frequency is brought close to the upper cutoff frequency while link frequency characteristics are made to have a sharp roll-off at the upper cutoff frequency, an upper sideband signal is suppressed so that a lower sideband signal may be outputted from the microstrip circuit on the transmitter side and demodulation using the lower sideband signal may be implemented on the receiver side.

Further, the embodiments of the invention may include all the contents related to the invention among those disclosed in Korean Patent Application No. 10-2013-0123344 of the same assignee.

For example, the embodiments of the invention may provide improved interconnects instead of electrical wired lines. The waveguide may be a dielectric waveguide having a metal cladding, and may replace conventional copper lines.

Further, the waveguide uses a dielectric with frequency-independent attenuation characteristics, and thus may achieve a high data rate even with no or little additional compensation at a receiver side or a receiving end. Parallel channel data transmission may be feasible through a vertical combination of the waveguide and a PCB. A PCB having a waveguide for a board-to-board interconnect between the transceiver I/O may be defined as a board-to-board interconnect apparatus.

For example, an interconnect apparatus according to one embodiment of the invention may comprise a waveguide, a transmitting-end board, a receiving-end board, a board-to-fiber connector, a microstrip feeding line, a probe element, a slotted ground plane, a ground plane, and a patch. Here, the interconnect apparatus may further comprise vias connecting the two ground planes to each other.

The board-to-fiber connector is provided to maximize space (area) efficiency by securely fixing a plurality of waveguides to the PCB to bring the waveguides as close to each other as possible. Physically, the flexible nature of the waveguide may support connecting any endpoints at any location in free space. The metal cladding of the waveguide may keep the overall transceiver power consumption constant regardless of the length of the waveguide. Further, the metal cladding may isolate interference of signals in other channels and adjacent waveguides. Here, the interference may cause bandwidth-limiting problems.

The patch-type microstrip-to-waveguide transition (MWT) coupled to a slot may minimize reflection between the microstrip and the waveguide. The microstrip-to-waveguide transition transmits a microstrip signal as a waveguide signal, which may have the advantage of low cost. This is because it may be manufactured through a general PCB manufacturing process.

A microstrip circuit according to one embodiment of the invention may comprise a microstrip feeding line, a probe element, a slotted ground plane, a ground plane, and a patch. The probe element may be provided in the microstrip circuit that well matches the microstrip line and the waveguide so as to adjust a slope of an upper cutoff frequency band. When the microstrip circuit brings a carrier frequency close to the upper cutoff frequency while causing link frequency characteristics to have a sharp roll-off at the upper cutoff frequency, an upper sideband signal is suppressed so that a lower sideband signal may be outputted from the microstrip circuit at the receiving end. Accordingly, the signal outputted to the receiver through the waveguide and the microstrip circuit may be a lower sideband signal, and demodulation may be implemented using the lower sideband signal at the receiver.

As described above, the microstrip circuit according to one embodiment of the invention may match the microstrip line and the waveguide to provide only single sideband data or data focused on the single sideband as an output of the microstrip circuit at the receiving end, without reflection in a predetermined band.

FIG. 1 shows the structure of a chip-to-chip interface for illustrating the invention.

Referring to FIG. 1, the chip-to-chip interface structure depicts a board-to-board interconnect, and a waveguide 101 may be used for the board-to-board interconnect. An input signal is inputted from an output of a 50 ohm-matched transmitter die 102 and propagated along a transmission line 103. A microstrip-to-waveguide transition (MWT) 104 on a transmitter-side board may convert a microstrip signal to a waveguide signal.

Here, the waveguide signal outputted by the MWT may be transmitted along the waveguide 101, and may be converted into a microstrip signal in an MWT 105 on a receiver-side board. Similarly, a signal received by the MWT on the receiver-side board may be transmitted along a transmission line 106 and may proceed to a 50 ohm-matched receiver input 107. Here, the dielectric waveguide may transmit the signal from the transmitter-side board to the receiver-side board.

Figure 2:
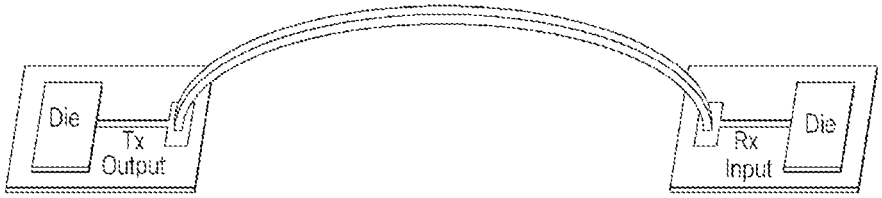
FIG. 2 schematically shows the structure of the interface of FIG. 1 as a model interconnected with a two-port network.
Figure 3:
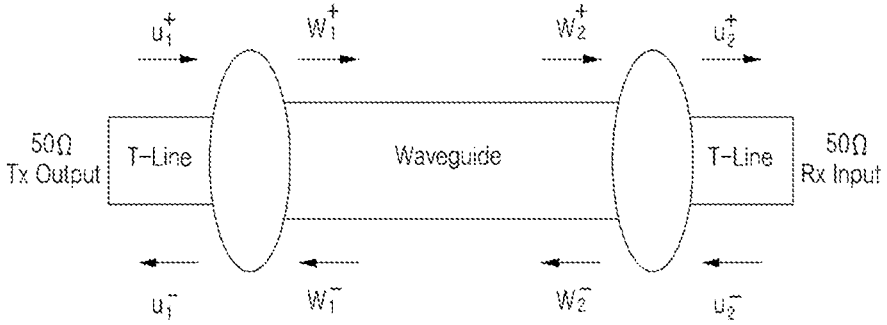
FIG. 3 shows an exemplary diagram for illustrating the relationship between reflected waves and transmitted waves at each transition.

FIG. 2 schematically shows the structure of the interface of FIG. 1 as a model interconnected with a two-port network, and FIG. 3 shows an exemplary diagram for illustrating the relationship between reflected waves and transmitted waves at each transition.

Referring to FIGS. 2 and 3, at each end of the waveguide, an impedance discontinuity may lower energy transfer efficiency from the transmission line (for Tx Output of Die on the left side in FIG. 2) to the waveguide and/or from the waveguide to the transmission line (for Rx Input of Die on the right side in FIG. 2). In order to analyze the effect of the discontinuity, the overall interconnect may be considered as a two-port network as shown in FIG. 2, and the reflected waves and the transmitted waves at each transition may be represented as shown in FIG. 3.

That is, as shown in FIG. 3, in the transition from the transmission line (i.e., T-Line for 50Ω Tx Output) to the waveguide, the input waves at the transmission line and the waveguide may be represented by $u_1^+$ and $w_1^-$, respectively, and the reflected waves at the transmission line and the waveguide may be represented by $u_1^-$ and $w_1^+$, respectively. Similarly, in the transition from the waveguide to the transmission line (i.e., T-Line for 50Ω Rx Input), the input waves at the waveguide and the transmission line may be represented by $w_2^+$ and $u_2^-$, respectively, and the reflected waves at the waveguide and the transmission line may be represented by $w_2^-$ and $u_2^+$, respectively.

From this simplified model, the relationship between the reflected waves and the transmitted waves may be modeled by Equations (1) to (3) as below.

$$\begin{bmatrix} u_1^- \\ w_1^+ \end{bmatrix} = \begin{bmatrix} r_1 e^{j\alpha_1} & t_2 e^{j\beta_2} \\ t_1 e^{j\beta_1} & r_2 e^{j\alpha_2} \end{bmatrix} \begin{bmatrix} u_1^+ \\ w_1^- \end{bmatrix} \tag{1}$$

$$\begin{bmatrix} w_2^+ \\ w_2^- \end{bmatrix} = \begin{bmatrix} se^{-jkl} & 0 \\ 0 & se^{-jkl} \end{bmatrix} \begin{bmatrix} w_1^+ \\ w_1^- \end{bmatrix} \tag{2}$$

$$\begin{bmatrix} w_2^- \\ u_2^+ \end{bmatrix} = \begin{bmatrix} r_2 e^{j\alpha_2} & t_1 e^{j\beta_1} \\ t_2 e^{j\beta_2} & r_1 e^{j\alpha_1} \end{bmatrix} \begin{bmatrix} w_2^+ \\ u_2^- \end{bmatrix} \tag{3}$$

Here, s denotes attenuation along the waveguide; $r_1 e^{j\alpha 1}$ denotes a complex reflection coefficient at the transition from the transmission line to the waveguide (hereinafter, "$R_1$"); $t_1 e^{j\beta 1}$ denotes a complex transmission coefficient at the transition from the transmission line to the waveguide (hereinafter, "$T_1$"); $r_2 e^{j\alpha 2}$ denotes a complex reflection coefficient at the transition from the waveguide to the transmission line (hereinafter, "$R_2$"); and $t_2 e^{j\beta 2}$ denotes a complex transmission coefficient at the transition from the waveguide to the transmission line (hereinafter, "$T_2$").

A scattering matrix (e.g., S-parameter) for the interconnect modeled as a two-port network may be represented by Equations (4) to (7) as below.

$$\begin{bmatrix} u_1^- \\ u_2^+ \end{bmatrix} = \begin{bmatrix} S_{11} & S_{12} \\ S_{21} & S_{22} \end{bmatrix} \begin{bmatrix} u_1^+ \\ u_2^- \end{bmatrix} \tag{4}$$

$$|S_{21}| = \left| s \frac{T_1 T_2 - R_1 R_2 - R_1}{E - E^{-1} R_2^2} \right| \tag{5}$$

$$|S_{11}| = \left| \frac{E R_1 - E^{-1} R_2 (T_1 T_2 - R_1 R_2)}{E - E^{-1} R_2^2} \right|^2 \tag{6}$$

$$\text{Group Delay} = -\frac{d}{d\omega} \angle S_{21} \tag{7}$$

$$\angle S_{21} = \tan^{-1}\left( \frac{\text{Img}\{T_1 T_2\} - \text{Img}\{R_1 R_2\} - \text{Img}\{R_1\}}{\text{Re}\{T_1 T_2\} - \text{Re}\{R_1 R_2\} - \text{Re}\{R_1\}} \right) - \tan^{-1}\left( \frac{\text{Img}\{E\} - \text{Img}\{R_1 R_2 E^{-1}\}}{\text{Re}\{E\} - \text{Re}\{R_1 R_2 E^{-1}\}} \right)$$

In Equations (4) to (7), $S_{11}$ is a reflection coefficient at port 1; $S_{12}$ is a voltage gain from port 2 to port 1; $S_{21}$ is a voltage gain from port 1 to port 2; $S_{22}$ is a reflection coefficient at port 2; E is defined as $e^{jkl}$ where k denotes a wavenumber of a propagating wave and l denotes a length of the interconnect; Img{x} denotes the imaginary part of x; and Re{x} denotes the real part of x.

Figure 4:
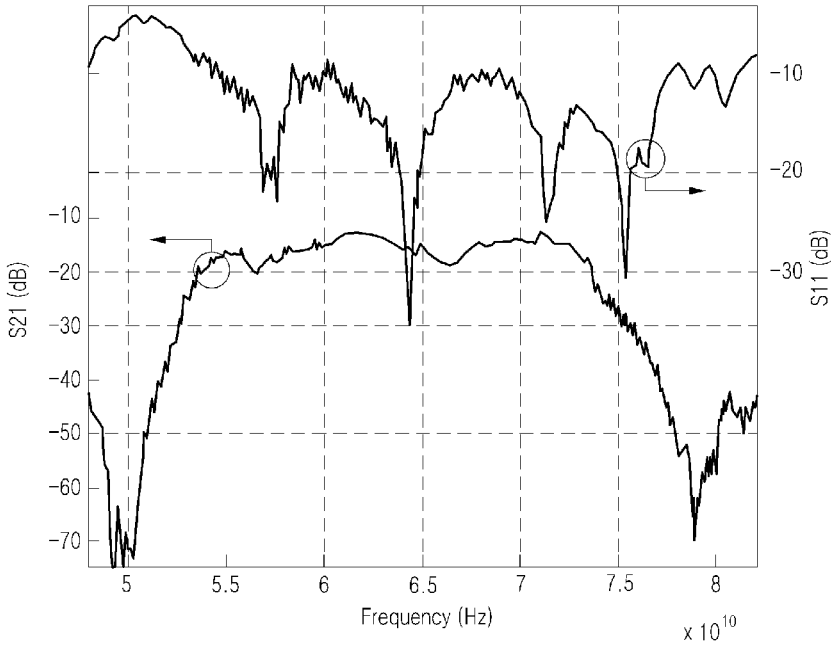
FIG. 4 shows an exemplary graph of an S-parameter measured for a 0.5 m E-tube channel.
Figure 5:
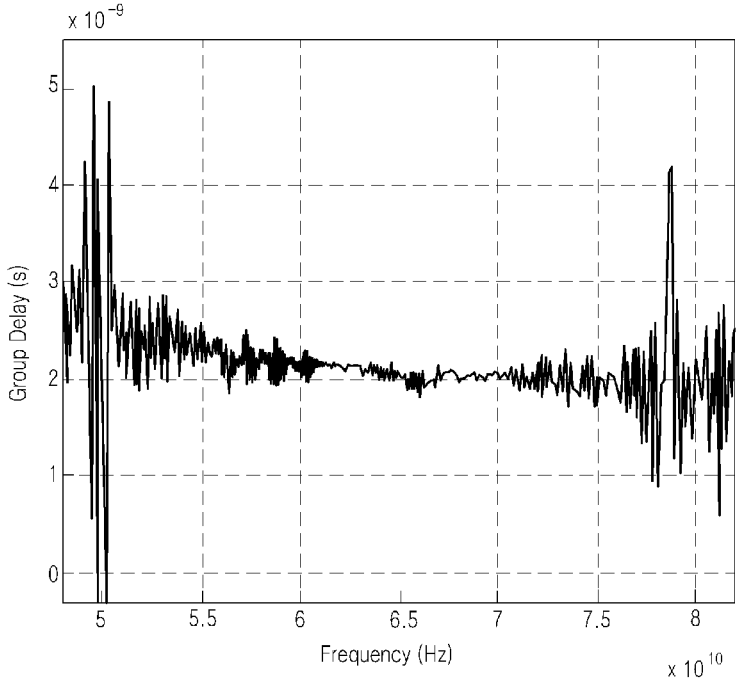
FIG. 5 shows an exemplary graph of a group delay measured for the 0.5 m E-tube channel.

FIG. 4 shows an exemplary graph of S-parameters $S_{21}$ and $S_{11}$ (in dB) vs. frequency (in Hz) measured for a 0.5 m E-tube channel, and FIG. 5 shows an exemplary graph of a group delay (in seconds s) vs. frequency (in Hz) measured for the 0.5 m E-tube channel.

Here, the E-tube refers to a combination of a transmitting-end board including a microstrip circuit, a waveguide, and a receiving-end board including a microstrip circuit.

As can be seen from the S-parameter results indicating the characteristics of the E-tube channel shown in FIG. 4, the 0.5 m E-tube channel has a return loss (S11) of 10 dB or less in the frequency range of 56.4 to 77.4 GHz, and has an insertion loss (S21) of 13 dB at 73 GHz. Further, the E-tube channel may have an insertion loss of 4 dB/m along the channel length.

Since the waveguide is a dispersive medium, the boundary condition of the waveguide may be expressed in terms of the relationship between a propagation constant β and a frequency w. It can be seen that a group delay dβ/dw for the waveguide is inversely proportional to the frequency as shown in FIG. 5.

The graphs shown in FIGS. 3 and 4 may imply that there is an oscillation that is dependent on the waveguide length with respect to the overall interconnect. That is, the longer the waveguide, the more severe the influence of the oscillation. If an eye diagram is used as a metric for evaluation of such a transmission system, the oscillation may cause serious problems in eye opening and zero crossing, and may even become a major cause for an increase in a bit error rate (BER).

The oscillation present in the results for the S-parameters and the group delay may be caused by the following facts. The reflected waves that occur in an impedance discontinuity undergo some attenuation as they are propagated, which may create a phenomenon similar to what happens in a cavity resonator. These waves may be scattered back and forth within the waveguide to stabilize standing waves.

These problems may be resolved by methods or strategies including 1) making a reflection coefficient (r2) as small as possible, 2) ensuring a relatively small level of channel loss while making accurate attenuation along the waveguide, and 3) constructing a waveguide using a material with low permittivity.

These strategies may be verified by Equations (5) to (7). Therefore, the MWT in the present invention may be used for the purpose of making a lower reflection coefficient (r2).

Figure 6:
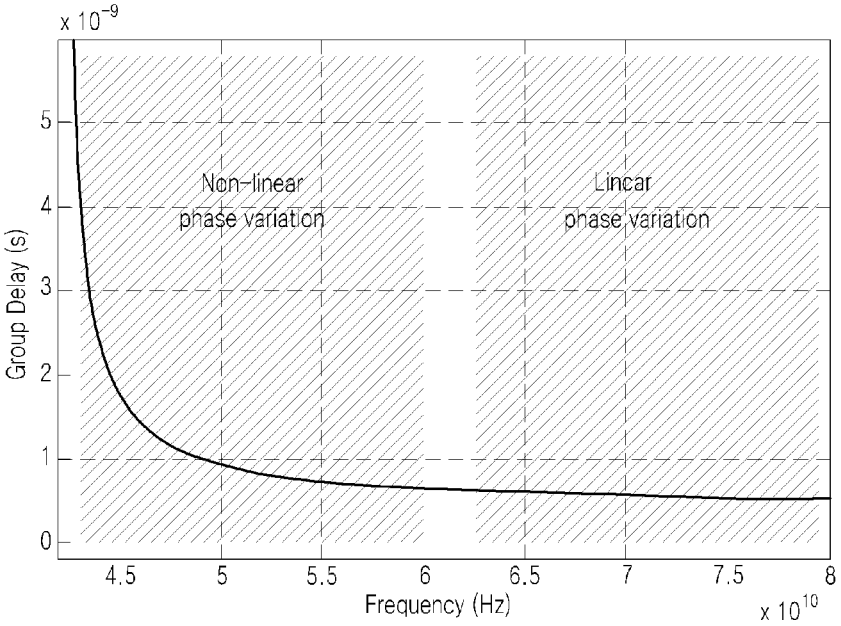
FIG. 6 shows a graph of a simulation result for a group delay of a waveguide.

Further, as can be seen from a graph of a simulation result for a group delay (in seconds s) vs. frequency (in Hz) of the waveguide as shown in FIG. 6, a carrier frequency should be located far away from the section where the group delay is rapidly changed (e.g., located where linear phase variation occurs), in order to alleviate distortion effect due to non-linear phase variation (shown on the left side of the graph).

Figure 7:
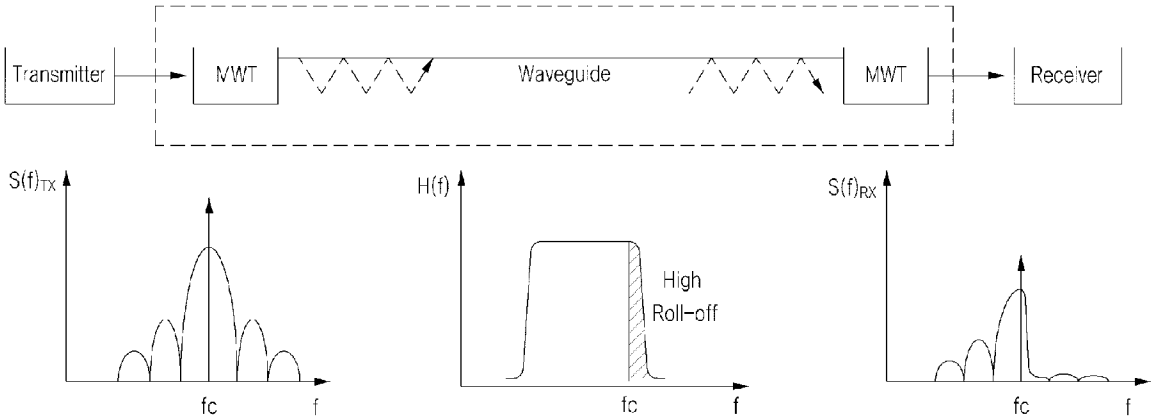
FIG. 7 shows an exemplary diagram for illustrating data transmission through a waveguide.

FIG. 7 shows an exemplary diagram for illustrating data transmission of a board-to-board interconnect apparatus according to one embodiment of the invention, wherein a transmission signal transmitted at a transmitter side (i.e., "Transmitter" in FIG. 7), a signal transmitted to a waveguide (i.e., "Waveguide" in FIG. 7) through an MWT (i.e., "MWT" in FIG. 7), and a reception signal received at a receiver side (i.e., "Receiver" in FIG. 7) are shown. Specifically, the graphs in FIG. 7 illustrate a power spectrum of a propagating signal at the transmitter side (denoted as $S(f)_{Tx}$), a frequency response of the interconnect (denoted as H(f)), and a power spectrum of the propagating signal at the receiver side (denoted as $S(f)_{Rx}$), respectively, wherein f denotes frequencies and fc denotes a carrier frequency of the propagating signal.

As shown in FIG. 7, the board-to-board interconnect apparatus according to one embodiment of the invention may use a microstrip circuit including an MWT to suppress an upper sideband signal of the transmission signal and output the transmission signal whose upper sideband signal is suppressed to the receiver, so that the transmission signal focused on a lower sideband signal may be received at the receiver side, and thus demodulation may be implemented using the lower sideband signal at the receiver side.

That is, the microstrip circuit according to one embodiment of the invention may well match the microstrip line and the waveguide to adjust a slope of an upper cutoff frequency band, and may bring a carrier frequency close to an upper cutoff frequency while causing link frequency characteristics to have a sharp roll-off at the upper cutoff frequency, thereby providing the receiver with the transmission signal focused on a lower sideband signal having a less delay change.

The embodiments of the invention may provide a transmission signal focused on a lower sideband signal to a receiver, and thus may utilize an available bandwidth twice wider than that of a dual sideband demodulation scheme.

Further, the embodiments of the invention may perform effective data transmission with a bandwidth wider than that of a RF wireless technique due to cutoff channel characteristics exhibiting high roll-off.

The high roll-off may be achieved by mutual interaction of a microstrip circuit including an MWT of a transmitting end, a waveguide, and a microstrip circuit including an MWT of a receiving end.

Figure 8:
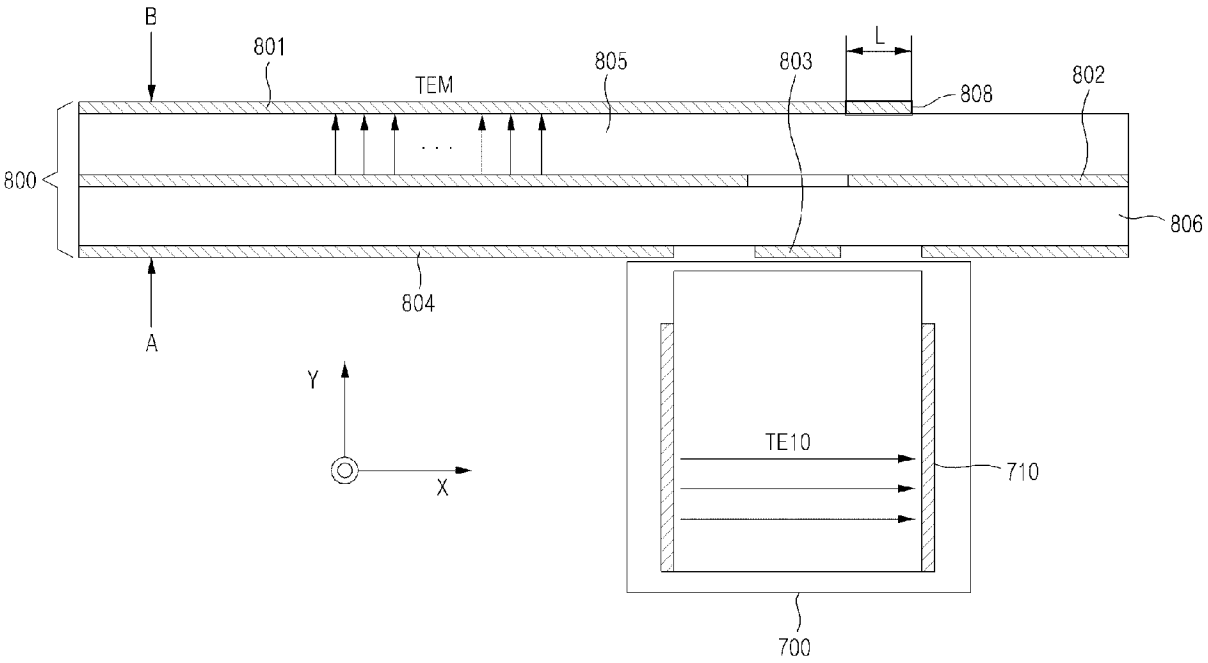
FIG. 8 shows a side view of a microstrip circuit according to one embodiment of the invention.
Figure 9A:
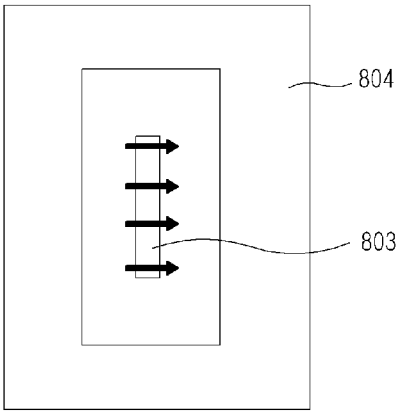
FIGS. 9A and 9B show top views of the microstrip circuit as seen in the directions A and B of FIG. 8.
Figure 9B:
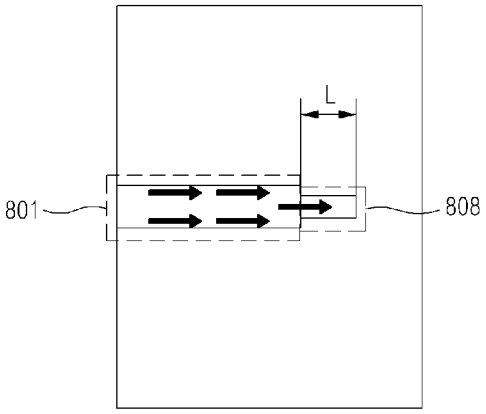
Figure 10:
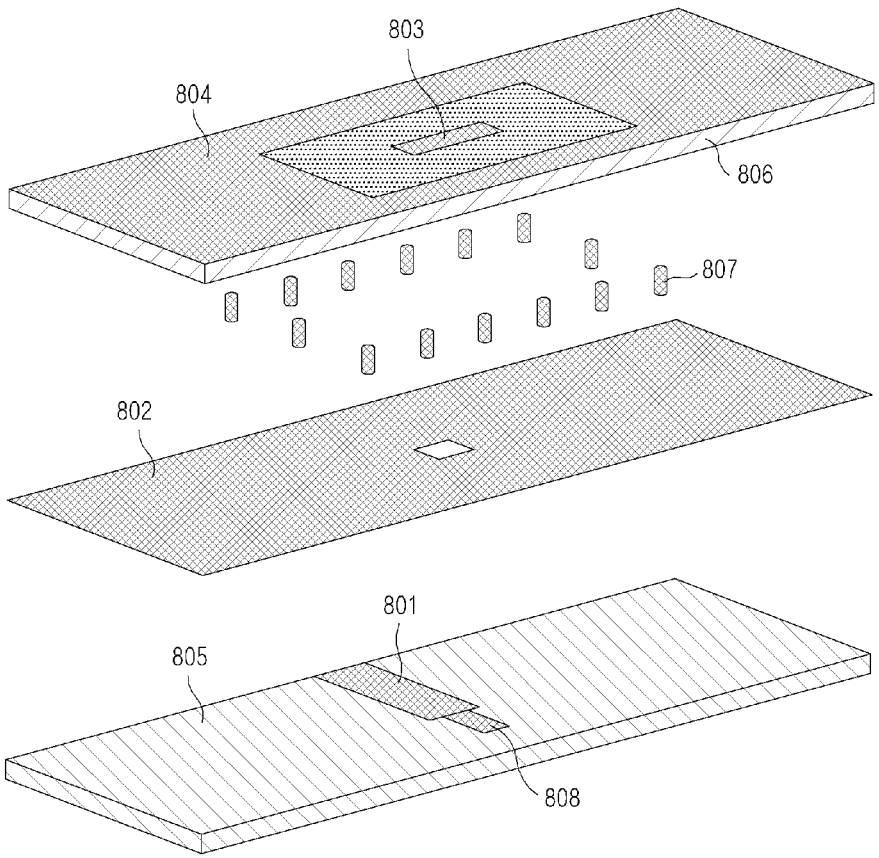
FIG. 10 shows an exploded view of the microstrip circuit of FIG. 8.

FIG. 8 shows a side view of a microstrip circuit according to one embodiment of the invention. FIGS. 9A and 9B show top views of the microstrip circuit as seen in the direction A (i.e., the same direction as the direction Y) and direction B (i.e., the opposite direction of the direction Y) of FIG. 8, respectively. FIG. 10 shows an exploded view of the microstrip circuit of FIG. 8.

Referring to FIGS. 8, 9A, 9B and 10, a microstrip circuit 800 according to the embodiment of the invention is connected to a waveguide 700 as shown in FIG. 8. Of course, the microstrip circuit 800 may also be wired to an RF circuit other than a waveguide.

The waveguide 700 includes a metal cladding 710 and may be connected to the microstrip circuit 800 as shown in FIG. 8. In particular, the waveguide 700 may be connected to a patch element 803 (FIGS. 8, 9A and 10) of the microstrip circuit 800, and the waveguide 700 may be a dielectric waveguide having the metal cladding 710.

Here, the metal cladding 710 may enclose the waveguide 700. For example, the metal cladding 710 may include a copper cladding, and the patch element 803 may include a microstrip line. The patch element 803 may radiate a signal to the waveguide 700 at a resonance frequency, or may radiate a signal to an RF circuit at a resonance frequency when it is wired to the RF circuit.

The metal cladding 710 may enclose the waveguide 700 in a predetermined form. For example, the metal cladding 710 may be formed to expose a middle portion of the waveguide 700, or may be punctured to expose a specific portion of the waveguide 700. The form of the metal cladding is not limited thereto the foregoing, and may include a variety of forms.

One end of the waveguide 700 may indicate an isometric projection of a tapered waveguide (not shown), which may enable impedance matching between dielectrics used for the waveguide 700 and the microstrip circuit 800 on the board. For example, the proportionality of the length of the metal cladding 710 in the length of the waveguide 700 may be designed based on the length of the waveguide 700.

Further, since the size of the waveguide 700 determines impedance of the waveguide 700, the optimal impedance may be efficiently found by linearly shaping at least one of both ends of the waveguide 700. That is, at least one of both ends of the waveguide 700 may be tapered for impedance matching between the dielectric waveguide and the microstrip circuit (not shown). For example, at least one of both ends of the waveguide may be linearly shaped to optimize the impedance of the dielectric waveguide with the highest power transfer efficiency.

Furthermore, the waveguide 700 may be firmly fixed to the board using a board-to-fiber connector. For example, the waveguide 700 may be vertically connected to at least one of the transmitter-side board and the receiver-side board through the board-to-fiber connector.

The microstrip circuit may be formed on a board of a three-layer structure.

The microstrip circuit 800 may transmit only single sideband data, e.g., a lower sideband signal of a transmission signal, without reflection in a predetermined band, by matching the microstrip line and the waveguide 700. That is, the microstrip line and the waveguide are matched using the microstrip circuit, and the microstrip circuit of the transmitting end, the waveguide, and the microstrip circuit of the receiving end may interact with each other so that only the lower sideband signal of the transmission signal inputted to the microstrip circuit of the transmitting end is provided to the receiver through the output of the microstrip circuit of the receiving end.

A microstrip feeding line 801 and a probe element 808 may be located in a first layer as shown in FIGS. 8, 9B and 10, and a slotted ground plane 802 (FIGS. 8, 9B and 10) punctured through an aperture may be disposed in a second layer.

The patch element 803 and a ground plane 804 (FIGS. 8, 9A and 10) may be disposed in a third layer.

Here, the patch element 803 is coupled to the microstrip feeding line 801 by current induced in the direction in which current on the microstrip feeding line 801 flows, e.g., in the same direction as the direction X as shown in FIG. 8. Due to the coupling, a signal of the first layer may be propagated to the third layer.

The microstrip feeding line 801 may supply or feed a transmission signal to the microstrip circuit 800, and the probe element 808 may adjust a bandwidth of a first predetermined frequency band among frequency bands of the transmission signal.

Here, the bandwidth of the first frequency band may be the bandwidth of the frequency band corresponding to an upper sideband signal of the transmission signal, and the bandwidth of the frequency band corresponding to the upper sideband signal may be adjusted by the width and length of the probe element 808.

The probe element 808 is provided in the microstrip circuit that well matches the microstrip line and the waveguide so as to adjust a slope of an upper cutoff frequency band. The microstrip circuit brings a carrier frequency close to the upper cutoff frequency while causing link frequency characteristics to have a sharp roll-off at the upper cutoff frequency, thereby suppressing the upper sideband signal of the transmission signal. Here, the probe element 808 may adjust a slope of the upper cutoff frequency band with respect to the upper sideband signal of the transmission signal such that high roll-off occurs at the upper cutoff frequency, thereby providing only a single sideband signal to the receiver.

That is, the probe element 808 may cause high roll-off to the slope of the upper cutoff frequency band of the E-tube characteristics, so that only a specific frequency band signal (e.g., a lower sideband signal) of the transmission signal may be transmitted to the receiver.

The probe element 808 may have a characteristic impedance greater than a characteristic impedance of the microstrip feeding line 801, and may be connected to an end of the microstrip feeding line 801 and have a predetermined width and length.

The length L (FIGS. 8 and 9B) of the probe element 808 (the length parallel to an E-plane) may be determined based on a wavelength of a resonance frequency. For example, the length L of the probe element 808 may correspond to 10% of the wavelength of the resonance frequency.

Further, the width of the probe element 808 (the length parallel to an H-plane) may be 40 to 80% of the width of the microstrip feeding line 808.

As described above, the microstrip line and the waveguide are matched using the microstrip circuit including the probe element, and the microstrip circuit of the transmitting end, the waveguide, and the microstrip circuit of the receiving end may interact with each other to adjust a slope of an upper cutoff frequency band with respect to an upper sideband signal of the transmission signal inputted to the microstrip circuit of the transmitting end, and to cause high roll-off to occur at the upper cutoff frequency, thereby providing the receiver with only a lower sideband signal, or with the transmission signal focused on the lower sideband signal.

The slotted ground plane 802 may include a slot for minimizing a ratio of reverse-traveling waves to forward-traveling waves in the second layer.

Here, the sizes of the slot and the aperture may be important factors in signal transmission and reflection. The sizes of the slot and the aperture may be optimized by repetitive simulations to minimize the ratio of reverse-traveling waves to forward-traveling waves.

Here, the slot and the patch element 803 form a stacked geometry, and the stacked geometry may be one of the ways to increase the bandwidth.

The ground plane 804 and the slotted ground plane 802 form an electrical connection through vias 807 as shown in FIG. 10. Here, the vias 807 may be arranged in the form of an array, and may be formed in the third layer.

A substrate 805 (FIGS. 8 and 10) between the first and second layers may be comprised of CER-10 from Taconic.

Another core substrate 806 (FIGS. 8 and 10) between the second and third layers may be comprised of RO3010 Prepreg from Rogers.

The width of the microstrip feeding line 801, substrate thickness, slot size, patch size, via diameter, spacing between the vias, waveguide size, and waveguide material may be changed depending on a specific resonance frequency of the microstrip circuit and modes of traveling waves along the waveguide, which will be apparent to those skilled in the art.

The cutoff frequency and impedance of the waveguide may be determined by the size of an intersecting surface and the type of employed material. As the size of the intersecting surface of the waveguide is increased, the number of TE/TM modes that may be propagated may be increased, which may lead to an improvement in an insertion loss of the transition.

In FIG. 8, TEM denotes transverse electromagnetic modes in the substrate 805, and TE10 denotes transverse electric modes in the waveguide 700.

Further, the characteristics of the transition may be determined by a propagation mode of the waveguide, the slot, and a resonance frequency of the patch element 803.

Figure 11:
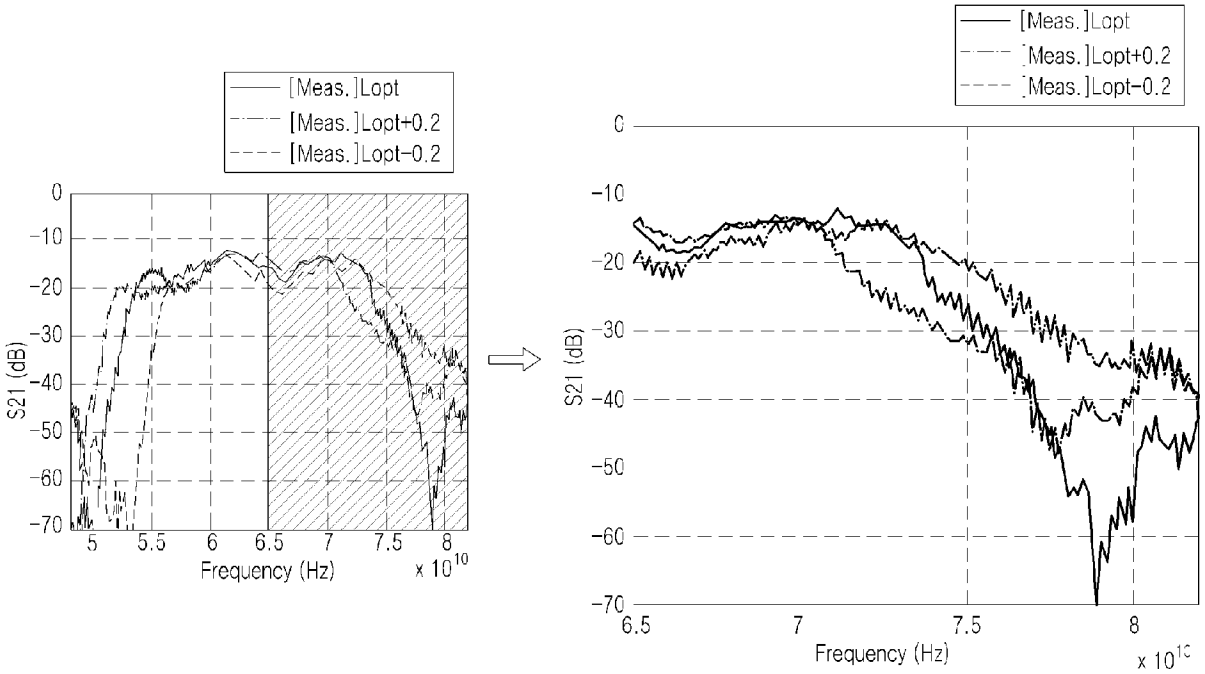
FIG. 11 shows an exemplary graph of an S-parameter measured along the length of a probe element shown in FIG. 8.

FIG. 11 shows an exemplary graph of an S-parameter $S_{21}$ (in dB) vs. frequency (in Hz) measured along the length of the probe element shown in FIG. 8, wherein upper cutoff changes are shown with respect to the measured lengths Lopt, Lopt+0.2 mm, and Lopt−0.2 mm of the probe element.

As shown in FIG. 11, it can be seen that a roll-off of 7.21 dB/GHz occurs when the length of the probe element is Lopt; a roll-off of 4.57 dB/GHz occurs when the length of the probe element is Lopt+0.2 mm; and a roll-off of 3.46 dB/GHz occurs when the length of the probe element is Lopt−0.2 mm. That is, the roll-off is maximized when the length of the probe element is Lopt, which is the optimal length for maximizing the roll-off.

As described above, the microstrip circuit according to one embodiment of the invention may maximize a roll-off for an upper sideband signal of a transmission signal inputted to a microstrip feeding line through interaction between a microstrip circuit of a receiving end, a waveguide, and a microstrip circuit of a transmitting end using a probe element, thereby providing a receiver with the transmission signal focused on a lower sideband signal so that the receiver may receive the transmission signal focused on the lower sideband signal and demodulate only the single sideband signal.

Although the present invention has been described in terms of the limited embodiments and the drawings, those skilled in the art may make various modifications and changes from the above description. For example, appropriate results may be achieved even when the above-described techniques are performed in an order different from the above description, and/or when the components of the above-described systems, structures, apparatuses, circuits and the like are coupled or combined in a form different from the above description, or changed or replaced with other components or equivalents.

Therefore, other implementations, other embodiments, and equivalents to the appended claims will fall within the scope of the claims.

What is claimed is:

1. A board-to-board interconnect apparatus comprising:

a waveguide which transmits a signal from a board on the side of a transmitter to a board on the side of a receiver and has a metal cladding; and a microstrip circuit which is formed on each of the transmitter-side board and the receiver-side board, wherein the microstrip circuit is connected to the waveguide and has a microstrip-to-waveguide transition (MWT), wherein the microstrip circuit adjusts a bandwidth of a first predetermined frequency band of the signal to provide the signal to the receiver, and wherein the bandwidth of the first predetermined frequency band is adjusted by adjusting a slope of an upper cutoff frequency band of the signal.

2. The board-to-board interconnect apparatus of claim 1, wherein the microstrip circuit comprises:

a microstrip feeding line which supplies the signal in a first layer of the board on which the microstrip circuit is formed;

a probe element which adjusts the bandwidth of the first predetermined frequency band;

a slotted ground plane including a slot for minimizing a ratio of reverse-traveling waves to forward-traveling waves in a second layer of the board on which the microstrip circuit is formed, wherein the forward-traveling waves travel from the microstrip circuit to the waveguide, and the reverse-traveling waves travel from the waveguide to the microstrip circuit;

a ground plane including vias for forming an electrical connection between the slotted ground plane and the ground plane in a third layer of the board on which the microstrip circuit is formed; and a patch which is disposed in the third layer and is electrically isolated from the ground plane and radiates the signal at a resonance frequency.

3. The board-to-board interconnect apparatus of claim 2, wherein the probe element has a characteristic impedance greater than a characteristic impedance of the microstrip feeding line.

4. The board-to-board interconnect apparatus of claim 2, wherein the probe element is connected to an end of the microstrip feeding line, and has a predetermined width and length.

5. The board-to-board interconnect apparatus of claim 4, wherein the length of the probe element is determined based on a wavelength of the resonance frequency.

6. The board-to-board interconnect apparatus of claim 4, wherein the width of the probe element is 40 to 80% of a width of the microstrip feeding line.

7. A microstrip circuit comprising:

a microstrip feeding line which supplies a signal in a first layer of a board on which the microstrip circuit is formed;

a probe element which adjusts a bandwidth of a first predetermined frequency band of the signal;

a slotted ground plane including a slot for minimizing a ratio of reverse-traveling waves to forward-traveling waves in a second layer of the board on which the microstrip circuit is formed, wherein the forward-traveling waves travel from the microstrip circuit to a waveguide connected to the microstrip circuit, and the reverse-traveling waves travel from the waveguide to the microstrip circuit;

a ground plane including vias for forming an electrical connection between the slotted ground plane and the ground plane in a third layer of the board on which the microstrip circuit is formed; and a patch which is disposed in the third layer and is electrically isolated from the ground plane and radiates the signal at a resonance frequency, wherein the bandwidth of the first predetermined frequency band is adjusted by adjusting a slope of an upper cutoff frequency band of the signal.

8. The microstrip circuit of claim 7, wherein the probe element has a characteristic impedance greater than a characteristic impedance of the microstrip feeding line.

9. The microstrip circuit of claim 7, wherein the probe element is connected to an end of the microstrip feeding line, and has a predetermined width and length.

10. The microstrip circuit of claim 9, wherein the length of the probe element is determined based on a wavelength of the resonance frequency.

11. The microstrip circuit of claim 9, wherein the width of the probe element is 40 to 80% of a width of the microstrip feeding line.

* * * * *